United States Patent [19]

Deutsch et al.

[11] Patent Number: 4,513,651

[45] Date of Patent: Apr. 30, 1985

[54] GENERATION OF ANHARMONIC OVERTONES IN A MUSICAL INSTRUMENT BY ADDITIVE SYNTHESIS

[75] Inventors: Ralph Deutsch, Sherman Oaks; Leslie J. Deutsch, Sepulveda, both of Calif.

[73] Assignee: Kawai Musical Instrument Mfg. Co., Ltd., Hamamatsu, Japan

[21] Appl. No.: 517,157

[22] Filed: Jul. 25, 1983

[51] Int. Cl.[3] ..... G10H 1/06

[52] U.S. Cl. ..... 84/1.22; 84/1.01

[58] Field of Search ..... 84/1.19, 1.01, 1.22, 84/1.23, 1.21

[56] References Cited

U.S. PATENT DOCUMENTS 4,223,583 9/1980 Deutsch ..... 84/1.22

*Primary Examiner*—Forester W. Isen

*Attorney, Agent, or Firm*—Ralph Deutsch

[57] ABSTRACT

A keyboard operated electronic musical instrument is disclosed which has a number of tone generators which are assigned to actuated keyswitches. Musical tones having an anharmonic overtones structure are produced by generating a number of component waveshapes each having a different fundamental frequency. These component waveshapes are summed to produce a single tone. Each component waveshape has a spectral content of a preselected subset of non-zero harmonic coefficients. The various components have mutually exclusive selection for the non-zero harmonic coefficients.

17 Claims, 8 Drawing Figures

GENERATION OF ANHARMONIC OVERTONES IN A MUSICAL INSTRUMENT BY ADDITIVE SYNTHESIS

BACKGROUND OF THE INVENTION

1. Field of the Invention

This invention relates to electronic music synthesis and in particular is concerned with the creation of musical tones which have anharmonic overtones.

2. Description of the Prior Art

For several acoustic musical instruments tones are produced for which the overtones are not true harmonics (integer multiples) of the fundamental frequency of the tone. The most familiar example of such an instrument is the conventional piano. Musical tones having anharmonic overtones have a characteristic timbre which is distinct and easily distinguishable from the timbre of tones having pure harmonic overtones.

Various systems have been described for electronic tone generators which are capable of creating tones with anharmonic overtones. In U.S. Pat. No. 3,888,153 entitled "Anharmonic Generation In A Computor Organ" a system is disclosed for producing tones having anharmonic overtones. Apparatus is described for creating, in real time, tones in which the fundamental frequency is at the true nominal musical pitch but in which the overtones are displaced from the true harmonic frequencies. The frequency displacement of the overtones is such that if an amount d is used for the second harmonic, then 2d is used for the third harmonic, and $(n-1)d$ is used for the n'th harmonic.

In U.S. Pat. No. 4,112,803 entitled "Ensemble And Anharmonic Generation In A Polyphonic Tone Synthesizer" apparatus is disclosed for producing an ensemble effect in a polyphonic tone synthesizer of the type wherein musical notes are produced polyphonically by computing a master data set, transferring the master data set to buffer memories, and repetitively converting in real time the contents of these memories into musical tones. A multiplicity of master data sets are created repetitively and independent of the tone generation by computing a Fourier algorithm using stored sets of harmonic coefficients. The phase of such master data sets are generated with time varying phase shifts to provide the out-of-tune ensemble effects. The phase shifted master data sets are combined and transferred to buffer memories from which data is converted into musical sounds. Anharmonic overtones are produced by inhibiting the phase shifts of the fundamental frequency components.

SUMMARY OF THE INVENTION

In a Polyphonic Tone Synthesizer of the type described in U.S. Pat. No. 4,805,644 a computation cycle and a data transfer cycle are repetitively and independently implemented to provide data which are converted into musical waveshapes. A sequence of computation cycles is implemented during each of which a plurality of master data sets are created. Each of these master data sets are compiled using a different subset of a set of harmonic coefficients. At the end of each computation cycle each one of the computed master data sets is stored in a corresponding associated main register.

Following each individual computation cycle, a transfer cycle is initated during which each of the stored master data sets in the plurality of main registers is transferred to an associated one of a plurality of note registers. There is a plurality of note registers associated with each of the tone generators. The tone generators are assigned to actuated keyboard switches.

The data stored in the set of note registers corresponding to a tone generator are read out sequentially and repetitively at a different memory advance rate for each of the note registers. The read out data is summed and the result is processed by a digital-to-analog converter to produce musical tones having anharmonic overtones. The output tone generation continues uninterrupted during the computation and transfer cycles.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic tone generator wherein a plurality of master data sets are combined at selected frequencies to produce a musical tone having anharmonic overtones. The anharmonic tone generation system is incorporated into a musical instrument of the type which synthesizes musical waveshapes by implementing a discrete Fourier transform algorithm. A tone generation system of this variety is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the reference patent. System element blocks which are identified by three digit numbers correspond to system elements added to the Polyphonic Tone Synthesizer or correspond to combinations of several elements appearing in the referenced patent.

Figure 1:
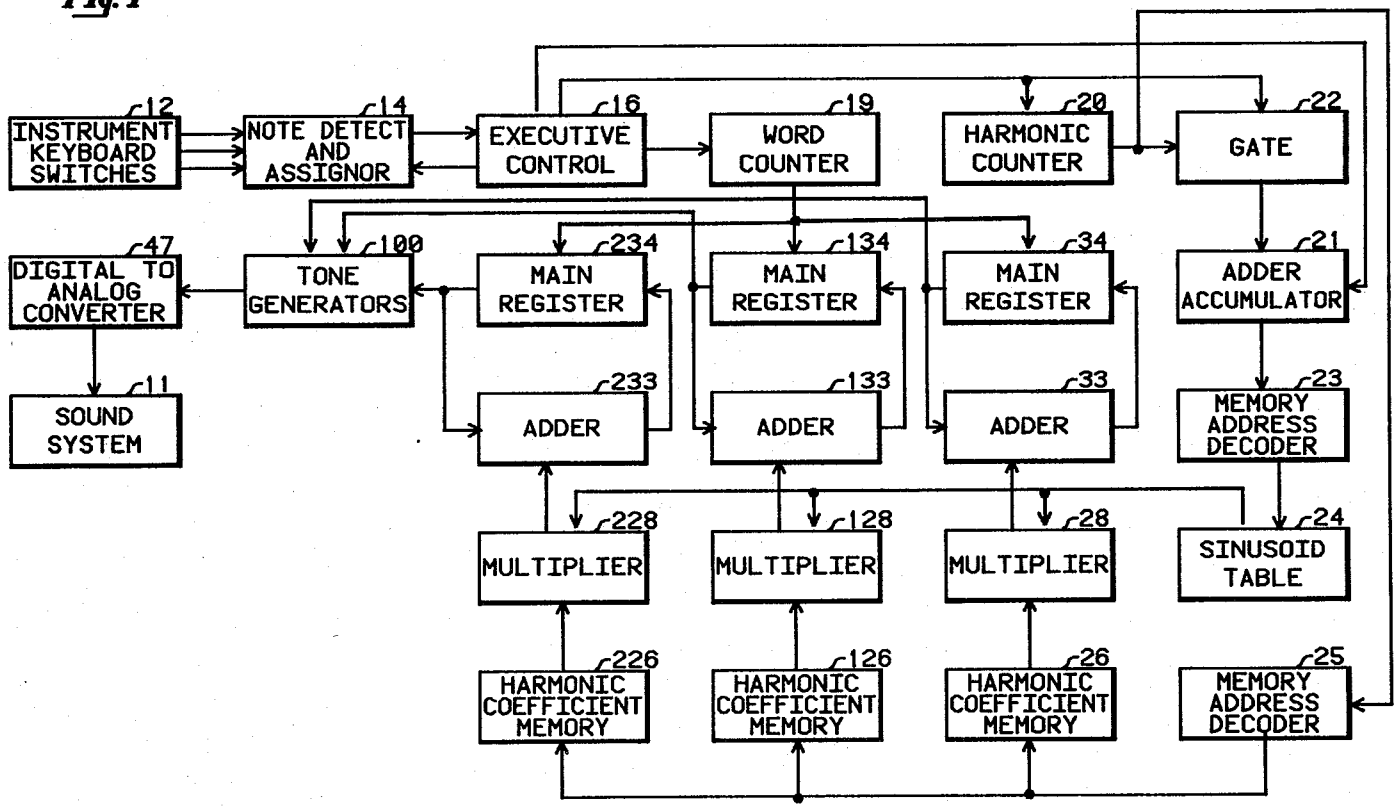
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. One member of the set of tone generators, contained in the system block labeled tone generators 100, is assigned to each actuated keyswitch using the information generated by the note detect and assignor.

A suitable note detect and assignor subsystem is described in U.S. Pat. No. 4,022,098 which is hereby incorporated by reference.

When one or more keyswitches have been actuated, the executive control 16 initiates a repetivive sequence of computation cycles. During each computation cycle, three master data sets each comprising 32 data words are computed in a manner described below. The first master data set is stored in the main register 34, the second master data set is stored in the main register 134, and the third master data set is stored in the main register 234. The 32 words of the first master data set are generated using a set of 16 harmonic coefficients which are stored in the harmonic coefficient memory 26. The 32 words of the second master data set are generated using a set of 16 harmonic coefficients which are stored in the harmonic coefficient memory 126. The 32 words of the third master data set are generated using a set of 16 harmonic coefficients which are stored in the harmonic coefficient memory 226.

The 32 data words in a master data set correspond to the amplitudes of 32 equally spaced points of one cycle of the audio waveform for the musical tone produced by a corresponding one of the tone generators 100. The general rule is that the maximum number of harmonics in the audio tone spectra is no more than one-half of the number of data points in one complete waveshape period. Therefore, a master data set comprising 32 data words corresponds to a maximum of 16 harmonics.

As described in the referenced U.S. Pat. No. 4,085,644 it is desirable to be able to continuously recompute and store the generated master data sets during a repetitive sequence of computation cycles and to load this data into the note registers associated with the tone generators while the actuated keys remain actuated, or depressed, on the keyboards.

In the manner described in the referenced U.S. Pat. No. 4,085,644 the harmonic counter 20 is initialized to its minimal, or zero, count state at the start of each computation cycle. Each time that the word counter 19 is incremented by the executive control 16 so that it returns to its initial, or minimal, count state because of its modulo counting implementation, a signal is generated by the executive control 16 which increments the count state of the harmonic counter 20. The word counter 19 is implemented to count modulo 32 which is the number of data words in each of the three component master data sets. The harmonic counter 20 is implemented to count modulo 16. This number corresponds to the maximum number of harmonics consistent with a master data set comprising 32 data words.

At the start of each computation cycle, the accumulator in the adder-accumulator 21 is initialized to a zero value by the executive control 16. Each time that the word counter 19 is incremented, the adder-accumulator 21 adds the current count state of the harmonic counter 20 to the sum contained in the accumulator. This addition is implemented to be modulo 32.

The content of the accumulator in the adder-accumulator 21 is used by the memory address decoder 23 to access trigonometric sinusoid values from the sinusoid table 24. The sinusoid table 24 is advantageously implemented as a read only memory storing values of the trigonometric function sin $(2\pi\phi/64)$ for $0 \leqq \phi \leqq 64$ at intervals of D. D is a table resolution constant.

The multiplier 28 multiplies the trigonometric value read out of the sinusoid table by a harmonic coefficient read out from the harmonic coefficient memory 26. The memory address decoder 25 reads out harmonic coefficients from the harmonic coefficient memories 26, 126, and 226 in response to the count state of the harmonic counter 20. The product value formed by the multiplier 28 is furnished as one input to the adder 33.

The contents of the main register 34 are initialized to a zero value at the start of a computation cycle. Each time that the word counter 19 is incremented, the content of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 16 complete cycles of 32 counts, the main register 34 will contain the first master data set which is the first one of the three component sets of waveshape data points.

The combination of the system elements contained in the blocks memory address decoder 25, harmonic coefficient memory 126, multiplier 128, adder 133, and main register 134 operate to simultaneously generate a second master data set in an analogous manner to that previously described for the first master data set. The second master data set resides in the main register 134. This is the second one of the three component sets of waveshape data points.

The combination of the system elements contained in the blocks memory address decoder 25, harmonic coefficient memory 226, multiplier 228, adder 233, and main register 234 operate to simultaneously generate a third master data set in an analogous manner to that previously described for the first master data set. The third master data set resides in the main register 234. This is the third one of the three component sets of waveshape data points.

Figure 2:
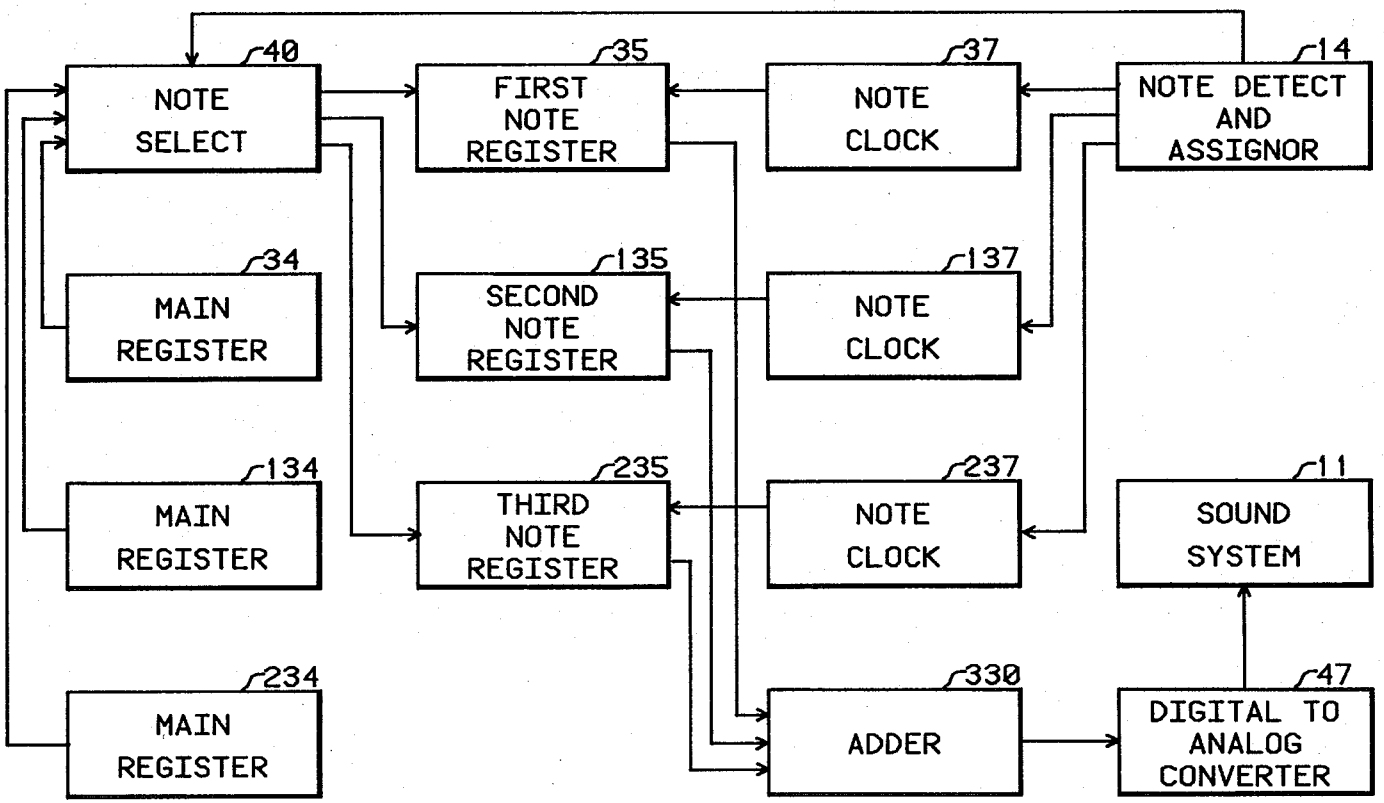
FIG. 2 is a schematic diagram of the note registers and data output system.

Following each computation cycle in the repetitive sequence of computation cycles a transfer cycle is initiated and executed. FIG. 2 illustrates the details of one of the tone generators contained in the system block labeled tone generators 100. During a transfer cycle, in a manner similar to that described in the referenced U.S. Pat. No. 4,085,644, the note select 40 directs a transfer of the first master data set from the main register 34 to the first note register 35. It also directs a transfer of the second master data set from the main register 134 to the second note register 135 and a transfer of the third master data set from the main register 234 to the third note register 235.

The master data sets stored in each of the three note registers 35, 135, and 235 are each read out sequentially and repetitively at a memory advance rate determined by note clocks each of which is associated with one of the note registers. As described below, each of the note clocks generate memory advance signals at different rates.

The data read out from the three note registers is summed by means of the adder 330 and the summed result is furnished to the digital-to-analog converter 47. The analog signal created by the digital-to-analog converter is furnished to the sound system 11 to be transformed into an audible signal.

In a preferred embodiment of the present invention the set of 16 harmonic coefficients stored in the harmonic coefficient memory have non-zero values for the harmonic number sequence 1,5,7,11, and 13. The non-zero valued harmonic coefficients are selected to conform to the harmonic structure of the desired tone to be produced by the tone generators. The set of 16 harmonic coefficients stored in the harmonic coefficient memory 126 have non-zero values for the harmonic number sequence 2,4,8,10,12,14 and 16. The non-zero valued harmonic coefficients are selected to conform to the harmonic structure of the desired tone to be produced by the tone generators. The set of 16 harmonic coefficients stored in the harmonic coefficient memory 228 have non-zero values for the harmonic number sequence 3,6,9 and 15. The non-zero valued harmonic coefficients are selected to conform to the harmonic structure of the desired tone to be produced by the tone generators. These three sets of harmonic coefficients are selected to have mutually exclusive non-zero values. That is, no two sets have a non-zero value for the same harmonic coefficient.

The three note clocks 37, 137 and 237 are operated at different, but related, frequencies for each tone generator assigned to a keyboard switch found to be an actuated state by the note detect and assignor 14. The note clock 37 is set of operate at a frequency $f_1$ which is equal to the number of data points in a master data set multiplied by the fundamental frequency of the musical note corresponding to the assigned actuated keyboard switch. The net result is that the first of the three component waveshapes generated by the system will have the harmonic sequence 1,5,7,11 and 13 as true harmonic overtones of the fundamental musical frequency.

The note clock 137 is set to operate at a frequency $f_2=f_1(1+0.48d)$. The net result is that the second of the three component waveshapes will be generated having non-zero amplitude overtones at the frequencies shown in Table 1.

TABLE 1

| Overtone | Frequency | True Harmonic Frequency |
|---|---|---|
| 1 | — | — |
| 2 | $2f_1 + 0.96df_1$ | $2f_1$ |
| 3 | — | — |
| 4 | $4f_1 + 1.92df_1$ | $4f_1$ |
| 5 | — | — |
| 6 | — | — |
| 7 | — | — |
| 8 | $8f_1 + 3.84df_1$ | $8f_1$ |
| 9 | — | — |
| 10 | $10f_1 + 4.8df_1$ | $10f_1$ |
| 11 | — | — |
| 12 | $12f_1 + 5.76df_1$ | $12f_1$ |
| 13 | — | — |
| 14 | $14f_16.72df_1$ | $14f_1$ |
| 15 | — | — |
| 16 | $16f_1 + 7.68df_1$ | $16f_1$ |

The note clock 237 is set of operate at a frequency $f_3=f_1(1+0.68d)$. The net result is that the third of the three component waveshapes will be generated having non-zero amplitude overtones at the frequencies shown in Table 2.

TABLE 2

| Overtone | Frequency | True Harmonic Frequency |
|---|---|---|
| 1 | — | — |
| 2 | — | — |
| 3 | $3f_1 + 2.04df_1$ | $3f_1$ |
| 4 | — | — |
| 5 | — | — |
| 6 | $6f_1 + 4.08df_1$ | $6f_1$ |
| 7 | — | — |
| 8 | — | — |

TABLE 2-continued

| Overtone | Frequency | True Harmonic Frequency |
|---|---|---|
| 9 | $9f_1 + 6.12df_1$ | $9f_1$ |
| 10 | — | — |
| 11 | — | — |
| 12 | — | — |
| 13 | — | — |
| 14 | — | — |
| 15 | $15f_1 + 10.2f_1$ | $15f_1$ |
| 16 | — | — |

The constant d is a preselected number that can be selectively controlled to vary the detuning of the resultant anharmonic overtones.

Figure 3:
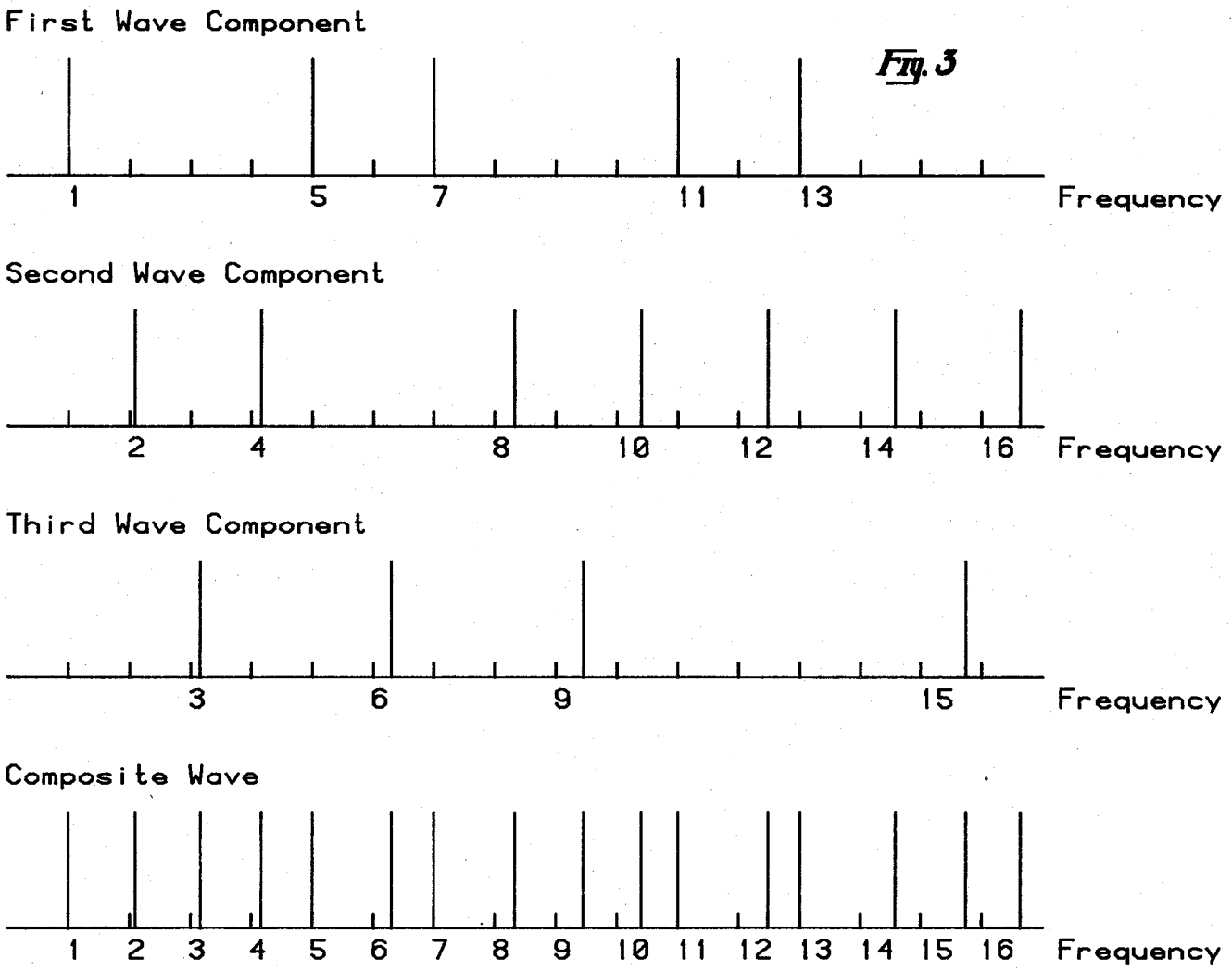
FIG. 3 is a composite spectra of the three tone components.

FIG. 3 illustrates how the addition of the three component waveshapes produced by the adder 330 creates a single waveshape which has the desired anharmonic overtones. The harmonic components are all shown with equal strength for graphic convenience. The first wave component, from the data read out of the first note register 35, contains the true in-tune harmonic components for the harmonic number sequence 1,5,7,11,13. The second wave component from the date read out of the second note register 135, contains the frequency offsets listed in Table 1 for the overtones corresponding to the harmonic sequence numbers 2,4,8,10,12,14,16. The third wave component, from the data read out from the third note register 235, contains the frequency offsets listed in Table 2 for the overtones corresponding to the harmonic sequence numbers 3,6,9,15. The composite spectra shown in FIG. 3 for the sum of the three composite waveshapes clearly indicates the anharmonic overtone structure of the generated musical tone spectra.

Figure 4:
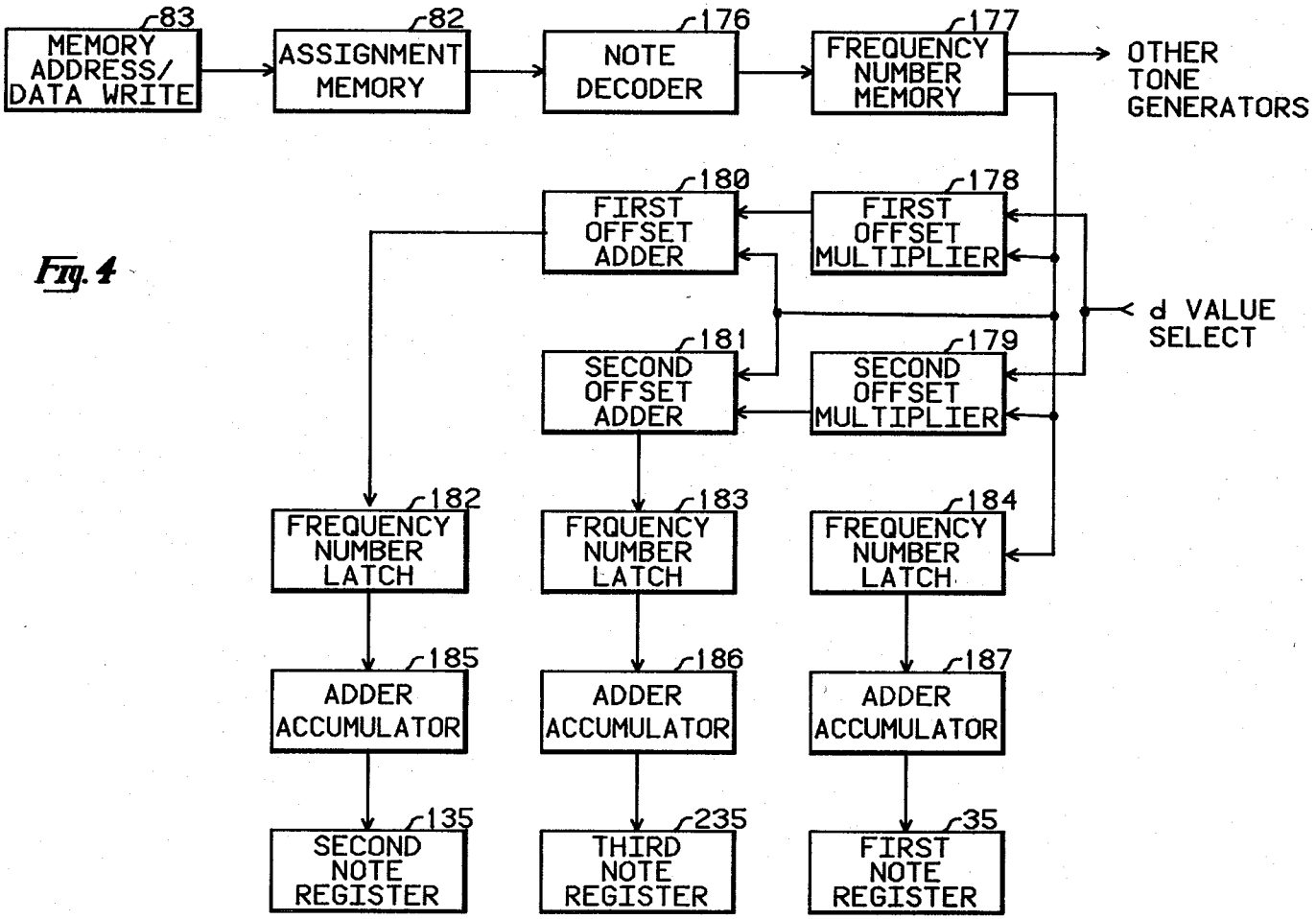
FIG. 4 is a schematic diagram of the note clocks.

FIG. 4 shows an implementation for the note clocks 37, 137 and 237 shown in FIG. 2. As described in the referenced U.S. Pat. No. 4,022,098 the note detect and assignor 14 contains an assignment memory 82 which stores a plurality of data words each of which corresponds to a tone generator. Each of these data words has been encoded to denote the assignment status of the corresponding tone generator, the musical instrument's keyboard division, the octave within the keyboard's range, and the musical note within the octave.

The tone generator assignment data words are read out of the assignment memory 82 in response to addresses provided by the memory address/date write 83. The note decoder 176 decodes the assignment data words read out of the assignment memory 82 to form a keyboard note number $K_n$. The keyboard note is formed by evaluating the expression $$K_n=(O_n-2).12+N_n. \qquad \text{Eq.1}$$

$O_n$ is the octave number and $N_n$ is the note number for the n'th tone generator. The convention adopted for note numbers is that the note C has the lowest value of N=1 and the note B has the highest value N=12. The octave number 0 for the lowest octave on an organ keyboard is O=2.

The frequency number memory 177 is a read-only addressable memory containing freqency numbers in binary numeric form having the values $2^{-(M-Kn)/12}$ where the keyboard note number has the range of values $K_n=1,2,\ldots,M$ and M is equal to the number of keyswitches on the keyboard of the musical instrument. The frequency numbers represent the ratios of the fundamental frequencies in an equal tempered musical scale.

In response to a note number $K_n$ decoded by the note decoder 176, a frequency number is read out of the frequency number memory 177. The accessed frequency number for a particular tone generator, such as the one shown in FIG. 4, is stored in a frequency number latch 184 and is also furnished as an input to the first offset multiplier 178 and the second offset multiplier 179.

A preselected and controllable value of the detuning constant d is furnished as a common input to both the first offset multiplier 178 and the second offset multiplier 179. The first offset multiplier 178 forms the product $0.48dR_1$, where $R_1$ is the frequency number read out of the frequency number memory 177. The second offset multiplier forms the product $0.68dR_1$.

The first offset adder 180 sums the product output from the first offset multiplier with the frequency number $R_1$ read out of the frequency number memory 177 to form the data value $R_1(1+0.48d)$. This data value is stored in the frequency number latch 182. In a similar fashion, the second offset adder 181 sums the product output from the second offset multiplier 179 with the frequency number read out of the frequency number memory 177 to form the data value $R_1(1+0.68d)$. this data value is stored in the frequency number latch 183.

There is an adder-accumulator in the set 185–187 associated with one of the frequency number latches 182–184. The frequency number stored in the associated frequency number latch is repetitively added to the contents of the accumulator in the corresponding adder-accumulator in response to timing signals produced by the system's master logic clock. The five most significant bits of the content of an accumulator is used to address out data values from its associated note register.

Figure 5:
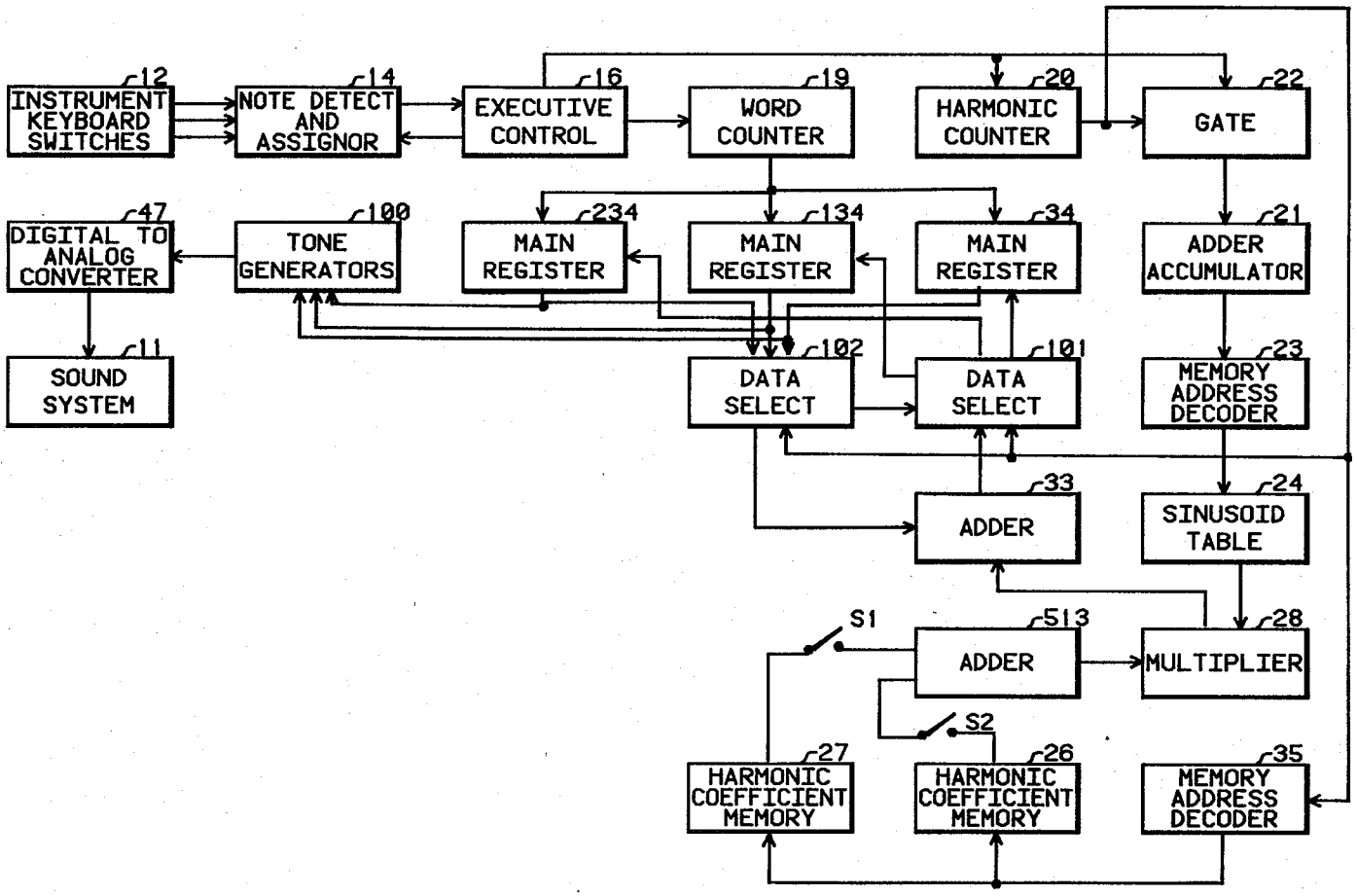
FIG. 5 is a schematic diagram of an alternate embodiment of the invention.

FIG. 5 shows an alternative embodiment of the present invention. The system shown in FIG. 5 uses only a single set of stored harmonic coefficients to generate the three component master data sets.

In response to the count state of the harmonic counter 20, data select 102 selects data read out of one of the main registers in the set 34, 134, 234 in a manner described below. The action of the data select 102 is such that for the states 1,5,7,11 and 13 of the harmonic counter 20 the data read out from the main register 34 is selected and transferred as an input to the adder 33. For count states 2,4,8,10,12,14 and 16 of the harmonic counter 20, the data select 102 transfers the data read out of the main register 134 to the adder 33. For count states 3,6,9, and 15 of the harmonic counter 20, the data select 102 transfers the data read out of the main register to the adder 33.

Data select 101 transfers the summed data created by the adder 33 to be stored in the proper main register in response to the count state of the harmonic counter 20 in a manner complementary to the selection logic of data select 102.

FIG. 5 shows two harmonic coefficient memories 26 and 27 each of which corresponds to a preselected musical tone. The choice of a tone is determined by the actuation of the switches S1 and S2. A sum tone can be created by actuating both S1 and S2 and adding the harmonic coefficients as they are read out of both harmonic coefficient memories by means of adder 513

Figure 6:
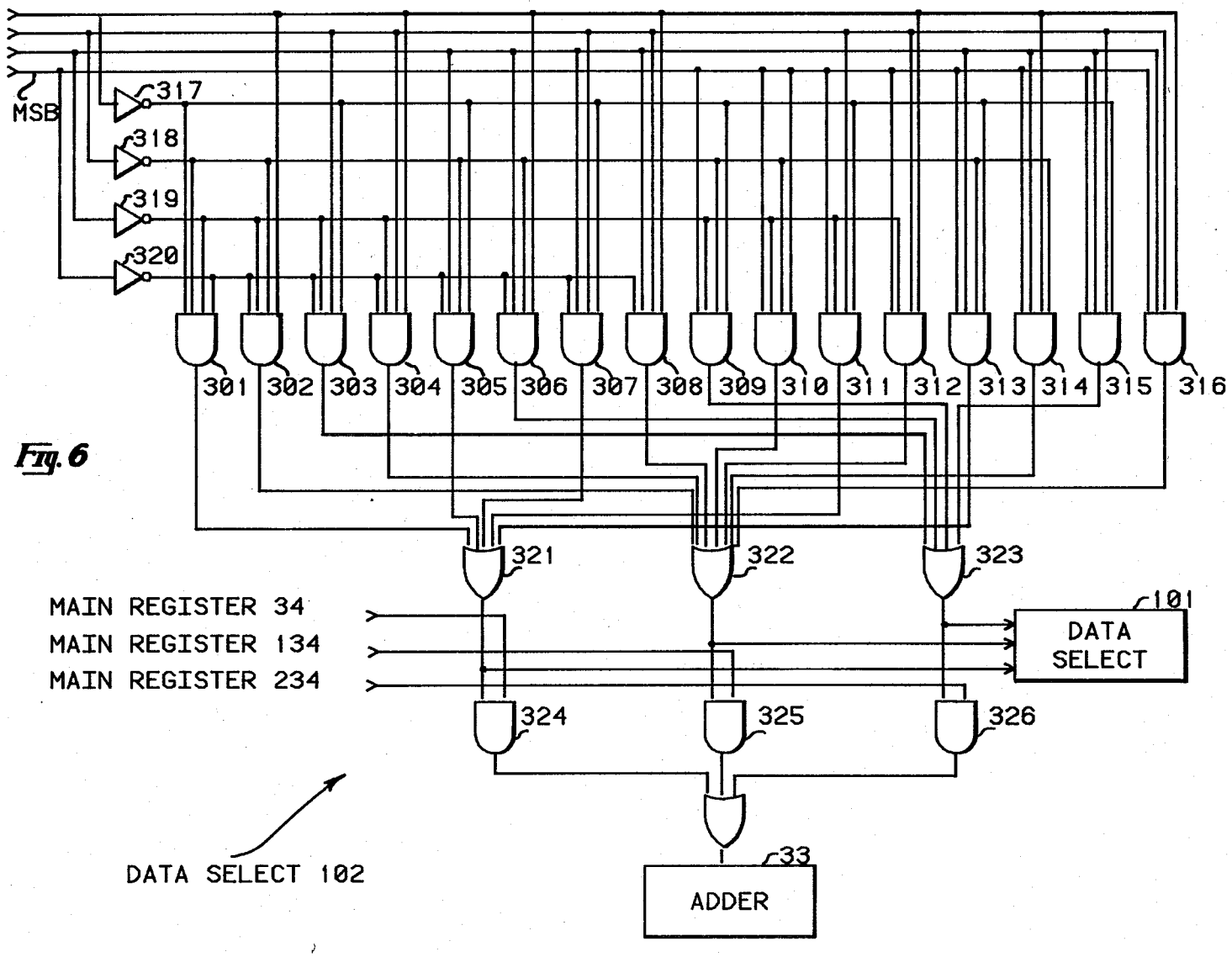
FIG. 6 is a logic diagram for the data select 102.

The detailed logic of the data select 102 is shown in FIG. 6. The set of AND-gates 301–316 in cooperation with the invertor gates 317–320 serve to decode the binary count states of the content of the harmonic counter 20 onto 16 harmonic select lines. The AND-gates 324–326 act to select the data read out of the three main registers in response to the count states of the harmonic counter 20 as they appear on the 16 decoded lines from the set of AND-gates 301–316.

The OR-gate 321 sums (logic OR operation) the decoded state lines corresponding to the 1,5,7,11,13 count states of the harmonic counter 20. The OR-gate 322 sums the decoded state lines corresponding to the 2,4,8,10,12,14,16 count states of the harmonic counter 20. The OR-gate 323 sums the decoded state lines corresponding to the 3,6,9,15 count states of the harmonic counter 20.

While FIG. 6 shows only a single data line for the data read out of the main registers, it is to be understood that the single line is simply a drawing convention for a set of data lines equal in number to the number of bits comprising a data word.

Figure 7:
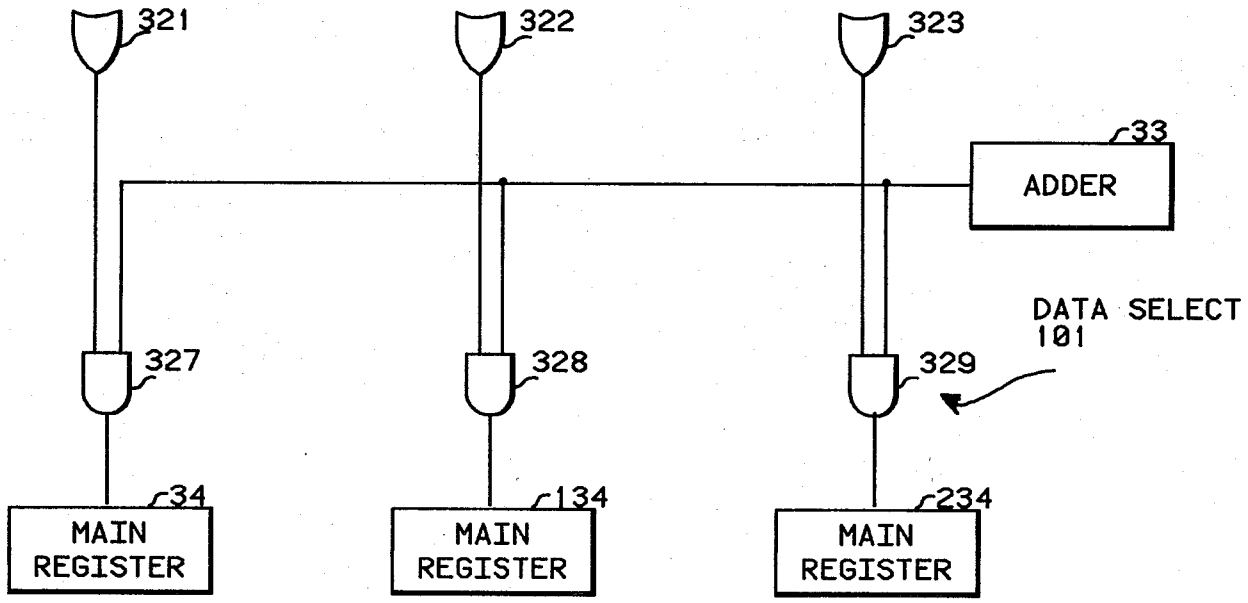
FIG. 7 is a logic diagram for the data select 101.

FIG. 7 illustrates the logic for the data select 101. The set of AND-gates 327–329 direct the output data from the adder 33 to one of the three main registers in response to the signal output states of the set of OR-gates 321–323. The operation of these OR-gates was previously described in relation to the subsystem shown in FIG. 6 for the data select 102.

Figure 8:
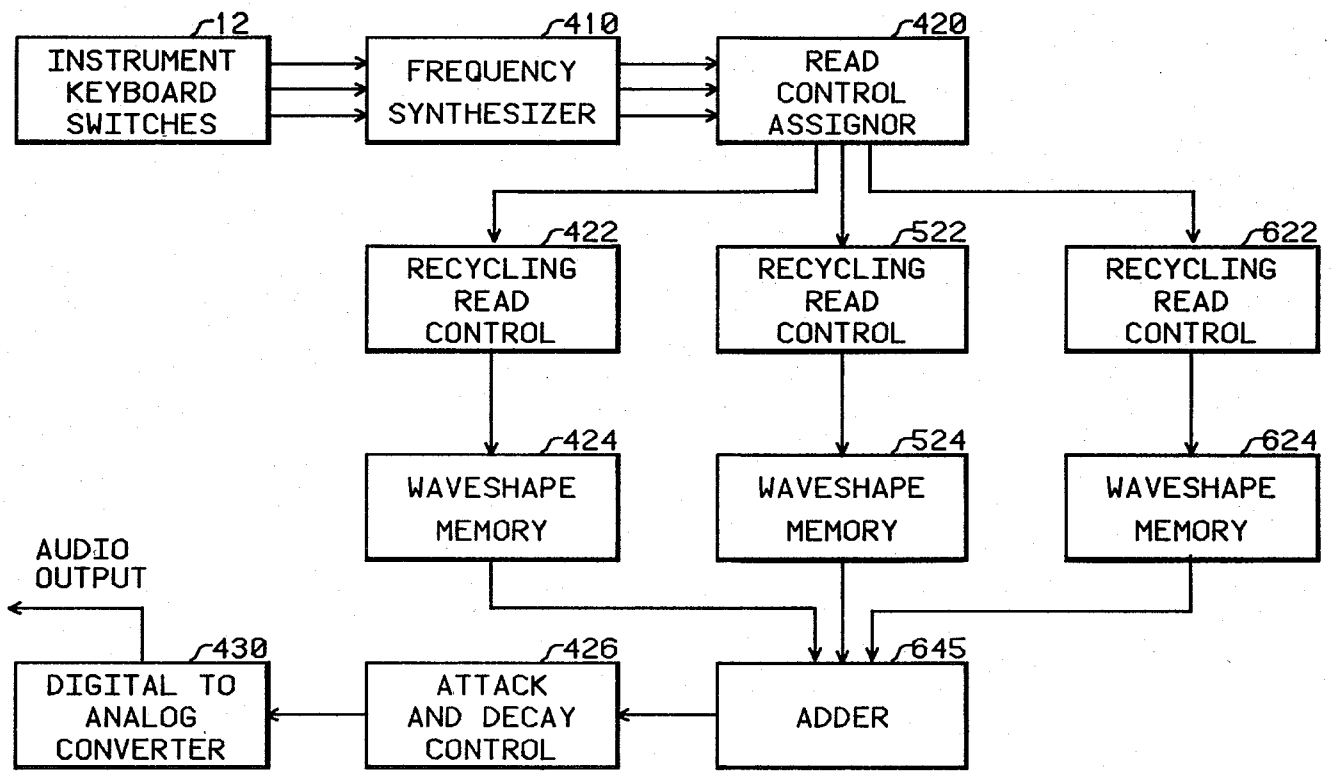
FIG. 8 is a schematic diagram of a further alternative embodiment of the invention.

The present invention can readily be incorporated into other types of musical tone generators to create tones having anharmonic overtones. FIG. 8 shows an alternative embodiment of the present invention incorporated into a system described in U.S. Pat. No. 3,515,792 entitled "Digital Organ." This patent is hereby incorporated by reference.

FIG. 8 has system logic blocks which correspond with those shown in FIG. 1 of the U.S. Pat. No. 3,515,792. The three waveshape memories 424,524, and 624 in FIG. 8 correspond in function to the three note registers shown in FIG. 2. The waveshape memory 424 contains a stored waveshape that comprises a tone whose non zero harmonics are limited to the harmonic sequence 1,5,7,11,13. The waveshape memory 524 contains a stored waveshape that comprises a tone whose non zero harmonics are limited to the harmonic sequence 2,4,8,10,12,14,16. The waveshape memory 624 contains a stored waveshape that comprises a tone whose nonzero harmonics are limited to the harmonic sequence 3,6,9,15. The three recycling read control 422,522,622 generate the three clock frquencies in analogy with the three note clocks shown in FIG. 2. The waveshape data points addressed out from the set of waveshape memories are summed by means of the adder 645. The summed data is amplitude modulated by the attack and decay control 426 and then the resulting signal is converted to an analog signal by the digital-to-analog converter 430.

The particular harmonic sequences described previously for generating the component master data sets are intended to show a prefferred embodiment as well as for illustrative purposes. Other harmonic sequence compositions can also be used to implement the present invention. The inventive concept is not limited to the composition of three component sets of waveshape data points as it is obvious that other numbers for the sets of waveshape data points can also be employed to create particular selected anharmonic overtones at preselected detuning offset values.

We claim:

1. In a keyboard musical instrument, having a keyboard array of keyswitches, in which a plurality of data words corresponding to amplitudes of points defining the waveform of a musical tone are computed during each one of a sequence of computation cycles and transferred sequentially to a means for producing musical waveshapes, apparatus for producing a musical tone having anharmonic overtones in response to an actuated keyboard keyswitch comprising;

a plurality of harmonic coefficient memory means each of which stores a different preselected set of harmonic coefficients having a subset of zero-valued harmonic coefficients and wherein each said subset of zero-valued harmonic coefficients are selected to be mutually exclusive of any other said subset of zero-valued harmonic coefficients, a harmonic memory addressing means whereby corresponding harmonic coefficients are simultaneously read out from each one of said plurality of harmonic coefficient memory means, a plurality of waveshape memory means each of which is associated with a corresponding one of said plurality of harmonic coefficient memory means, a means for computing responsive to harmonic coefficients read out from each one of said plurality of harmonic coefficient memory means whereby a plurality of component waveshape data points are computed during each one of said sequence of computation cycles wherein each one of said plurality of component waveshape data points is computed from a corresponding one of a preselected set of harmonic coefficients stored in an associated one of said plurality of harmonic coefficient memory means and whereby each one of said plurality of component data points is stored in a corresponding one of said plurality of waveshape memory means, a plurality of waveshape memory reading means each of which is associated with a corresponding one of said plurality of waveshape memory means whereby the component waveshape data points are sequentially and repetitively read out of each one of said plurality of waveshape memory means at different memory advance rates preselected for each one of said plurality of waveshape memory means, a data combining means whereby said waveshape data points read out of each one of said plurality of waveshape memory means are added to produce a composite set of waveshape data points corresponding to said musical tone having anharmonic overtones, and a means for producing musical waveshapes responsive to said composite set of waveshape data points whereby said musical tone having anharmonic overtones is produced.

2. In a musical instrument according to claim 1 wherein said plurality of harmonic coefficient memory means comprises;

a first addressable memory means containing a preselected set of a number N of harmonic coefficients wherein only the harmonic coefficients corresponding to the harmonic numbers 1,5,7,11, and 13 have a non-zero value and where N is the total number of harmonic coefficients in said preselected set of harmonic coefficients, a second addressable memory means containing a preselected set of a number N of harmonic coefficients wherein only the harmonic coefficients corresponding to the harmonic numbers 2,4,6,8,12,14, and 16 having a non-zero value, and a third addressable memory means containing a preselected set of a number N of harmonic coefficients wherein only the harmonic coefficients corresponding to the harmonic numbers 3,6,9, and 15 have a non-zero value.

3. In a musical instrument according to claim 1 wherein said means for computing comprises;

a logic clock means for providing logic timing signals, a word counter for counting said logic timing signals modulo the number of said plurality of data words corresponding to the amplitudes of points defining the waveform of a musical tone, a harmonic counter incremented each time said word counter returns to its minimal count state, a computer adder-accumulator means wherein the count state of said harmonic counter is successively added to the content of an accumulator in response to said logic timing signals and wherein the content of said accumulator is initialized to a zero value at the start of each one of said sequence of computation cycles, a sinusoid table storing a set of trigonometric function values, a sinusoid table addressing means responsive to the content of said computer adder-accumulator means for reading out a trigonometric function value from said sinusoid table, a plurality of multiplying means each of which is associated with a corresponding one of said plurality of waveshape memory means whereby each one of said plurality of multiplying means multiplies said trigonometric function value read out from said sinusoid table by one of said read out set of harmonic coefficients from a corresponding one of said plurality of harmonic coefficient memory means to form an output product value, and a plurality of summing means, each one of which is associated with a corresponding one of said plurality of multiplying means, wherein each one of said plurality of summing means sums said output product value from a corresponding one of said plurality of multiplying means with a data word read out from the corresponding one of said plurality of waveshape memory means and whereby the summed value is stored in said corresponding one of said plurality of waveshape memory means.

4. In a musical instrument according to claim 1 wherein said plurality of waveshape memory reading means comprises;

a keyswitch state detect means wherein a detect signal is generated in response to each actuated keyswitch in said keyboard array of keyswitches, a frequency number means responsive to each said detect signal wherein a plurality of different frequency numbers are generated each of which is associated with a corresponding one of said plurality of waveshape memory means, and a plurality of waveshape memory addressing means each of which is responsive to a corresponding one of said plurality of different frequency numbers whereby said component waveshape data points are sequentially and repetitively read out of each one of said plurality of waveshape memory means at different memory advance rates preselected for each one of said plurality of waveshape memory means.

5. In a musical instrument according to claim 4 wherein said frequency number means comprises;

a frequency number memory means for storing a set of frequency numbers, and a frequency number addressing means responsive to each said detect signal whereby a corresponding plurality of frequency numbers are read out from said frequency number memory means.

6. In a keyboard musical instrument, having a keyboard array of keyswitches, in which a plurality of data words corresponding to amplitudes of points defining the waveform of a musical tone are computed during each one of a sequence of computation cycles and transferred sequentially to a means for producing musical waveshapes, apparatus for producing a musical tone having anharmonic overtones in response to an actuated keyboard keyswitch comprising;

a plurality of harmonic coefficient memory means each of which stores a different preselected set of harmonic coefficients having a subset of zero-valued harmonic coefficients and wherein each said subset of zero-valued harmonic coefficients are selected to be mutually exclusive of any other said subset of zero-valued harmonic coefficients, a harmonic memory addressing means whereby corresponding harmonic coefficients are simultaneously read out from each one of said plurality of harmonic coefficient memory means, a plurality of waveshape memory means each of which is associated with a corresponding one of said plurality of harmonic coefficient memory means, a means for computing responsive to harmonic coefficients read out from each one of said plurality of harmonic coefficient memory means whereby a plurality of component waveshape data points are computed during each one of said sequence of computation cycles wherein each one of said plurality of component waveshape data points is computed from a corresponding one of a preselected set of harmonic coefficients stored in an associated one of said plurality of harmonic coefficient memory means and whereby each one of said plurality of component data points is stored in a corresponding one of said plurality of waveshape memory means, a frequency number memory means for storing a set of frequency numbers, a frequency number addressing means responsive to each said detect signal whereby a corresponding one of said set of frequency numbers is read out from said frequency number means, a plurality of frequency number multipliers each one of which is associated with a corresponding one of said plurality of waveshape addressing means and wherein each one of said plurality of frequency number multipliers multiplies said frequency number read out from said frequency number means by a preselected constant offset frequency number to form a scaled frequency number, a plurality of frequency number adders each one of which is associated with a corresponding one of said plurality of frequency number multipliers whereby each one of said plurality of frequency number adders adds said frequency number read out from said frequency number means with a corresponding scaled frequency number to form one of said plurality of frequency numbers a plurality of waveshape memory addressing means each of which is responsive to a corresponding one of said plurality of frequency numbers whereby said component waveshape data points are sequentially and repetitively read out of each one of said plurality of waveshape memory means at different memory advance rates preselected for each one of said plurality of waveshape memory means, a data combining means whereby said waveshape data points read out of each one of said plurality of waveshape memory means are added to produce a composite set of waveshape data points, and a means for producing musical waveshapes responsive to said composite set of waveshape data points whereby said musical tone having anharmonic overtones is produced.

7. In a keyboard musical instrument, having a keyboard array of keyswitches, in which a plurality of data words corresponding to amplitudes of points defining the waveform of a musical tone are computed during each one of a sequence of computation cycles and transferred sequentially to a means for producing musical waveshapes, apparatus for producing a musical tone having anharmonic overtones in response to an actuated keyboard keyswitch comprising;

a harmonic coefficient memory for storing a set of harmonic coefficients, a harmonic memory addressing means for reading out harmonic coefficients from said harmonic coefficient memory, a plurality of component waveshape memory means, a means for computing responsive to said harmonic coefficients read out from said harmonic coefficient memory whereby a set of component waveshape data points are computed during each one of said sequence of computation cycles, a component select means whereby each component waveshape data point is selectively stored in one of said plurality of component waveshape memory means according to a predetermined selection logic thereby generating a different component set of waveshape data points stored in each one of said plurality of waveshape memory means, a plurality of waveshape memory reading means each of which is associated with a corresponding one of said plurality of waveshape memory means whereby the stored component set of waveshape data points are sequentially and repetitively read out of each one of said pluality of component waveshape memory means at different memory advance rates preselected for each one of said plurality of waveshape memory means, a data combining means whereby said waveshape data points read out of each one of said plurality of component waveshape memory means are added to produce a composite set of waveshape data points corresponding to said musical tone having anharmonic overtones, and a means for producing musical waveshapes responsive to said composite set of waveshape data points whereby said musical tone having anharmonic overtones is produced.

8. In a musical instrument according to claim 7 wherein said plurality of waveshape memory reading means comprises;

a keyswitch state detect means wherein a detect signal is generated in response to each actuated keyswitch in said keyboard array of keyswitches, a frequency number means for generating a plurality of frequency numbers in response to each said detect signal, and a plurality of waveshape addressing circuity means each of which is associated with a corresponding one of said plurality of waveshape reading means and where each of which is responsive to a corresponding one of said plurality of frequency numbers whereby the component waveshape data points are sequentially and repetitively read out of each one of a corresponding one of said plurality of component waveshape memory means.

9. In a musical instrument according to claim 7 wherein said means for computing comprises;

a logic clock means for providing logic timing signals, a word counter for counting said logic timing signals modulo the number of said plurality of data words corresponding to the amplitudes of points defining the waveform of a musical tone, a harmonic counter incremented each time said word counter returns to its minimal count state, a computer adder-accumulator means wherein the count state of said harmonic counter is successively added to the content of an accumulator in response to said logic timing signals and wherein the content of said accumulator is initialized to a zero value at the start of each one of said sequence of computation cycles, a sinusoid table storing a set of trigonometric function values, a sinusoid table addressing means responsive to the content of said computer adder-accumulator means for reading out a trigonometric function value from said sinusoid table, a multiplying means for multiplying said trigonometric function value read out from said sinusoid table by one of said harmonic coefficients read out from said harmonic coefficient memory to form a product value, a component addressing means for simultaneously reading waveshape data points stored in each of said plurality of waveshape memory means, an input data select means responsive to the count state of said harmonic counter for selecting one of said waveshape data points read out from said plurality of waveshape memory means by said component addressing means, and a summing means for forming the sum of said selected waveshape data point with said product value to form one element of said set of component waveshape data points which is furnished to said component select means.

10. In a musical instrument according to claim 9 wherein said component select means comprises select circuitry responsive to the count state of said harmonic counter.

11. In a musical instrument according to claim 9 wherein said plurality of waveshape memory means comprises a first component waveshape memory, a second component waveshape memory, and a third component waveshape memory.

12. In a keyboard musical instrument, having a keyboard array of keyswitches, in which a plurality of data words corresponding to amplitudes of points defining the waveform of a musical tone are computed during each one of a sequence of computation cycles and transferred sequentially to a means for producing musical waveshapes, apparatus for producing a musical tone having anharmonic overtone in response to an actuated keyboard keyswitch comprising;

a harmonic coefficient memory for storing a set of harmonic coefficients, a harmonic memory addressing means for reading out harmonic coefficients from said harmonic coefficient memory, a plurality of component waveshape memory means including a first component waveshape memory, a second component waveshape memory, and a third component waveshape memory, a logic clock for providing logic timing signals, a harmonic counter for counting said logic timing signals, a harmonic addressing means for reading out harmonic coefficients from said harmonic coefficient memory in response to the content of said harmonic counter, a means for computing responsive to said harmonic coefficients red out from said harominc coefficient memory whereby a set of component waveshape data points are computed during each one of said sequence of computation cycles, a component select means whereby said component waveshape data points are stored in said first component waveshape memory in response to count states 1,5,7,11 and 13 of said harmonic counter, whereby said component select means stores said waveshape data in said second component waveshape memory in response to count states, 2,4,8,10,12,14 and 16 of said harmonic counter, and whereby said component select means stores said waveshape data in said third component waveshape memory in response to count states 3,6,9 and 15 of said harmonic counter, a plurality of waveshape memory reading means each of which is associated with a corresponding one of said plurality of waveshape memory means whereby the stored component set of waveshape data points are sequentially and repetitively read out of each one of said plurality of component waveshape memory means at memory advance rates preselected for each one of said plurality of waveshape memory means, a data combining means whereby said waveshape data points read out of each one of said plurality of component waveshape memory means are added to produce a composite set of waveshape data points corresponding to said musical tone having anharmonic overtones, and a means for producing musical waveshapes responsive to said composite set of waveshape data points whereby said musical tone having anharmonic overtones is produced.

13. In a musical instrument according to claim 12 wherein said input data select means comprises input select circuitry whereby the response to count states 1,5,7,11 and 13 of said harmonic counter data is selected from the read out from said first component waveshape memory, in response to count states 2,4,8,10,12,14 and 16 of said harmonic counter data is selected from the read out from said second component waveshape memory, and in response to count states 3,6,9,15 of said harmonic counter data is selected from the read out from said third component waveshape memory.

14. In a keyboard musical instrument having a keyboard array of keyswitches, apparatus for producing a musical tone having anharmonic overtones comprising;

a plurality of waveshape memory means each of which stores a component waveshape data set corresponding to a preselected set of N harmonic coefficients having a subset of zero valued harmonic coefficients and wherein each subset of zero valued harmonic coefficients are selected to be mutually exclusive of any other said subset of zero valued harmonic coefficients, a plurality of waveshape reading means each of which is associated with a corresponding one of said pluality of waveshape memory means whereby the component waveshape data points are sequentially and repetitively read out of each one of said plurality of waveshape memory means at memory advance rates preselected for each one of said plurality of waveshape memory means, a summing means for summing said component waveshape data set values read out from each one of said plurality of waveshape memory means to form a combination waveshape data point corresponding to said musical tone having anharmonic overtones, and a means for producing musical waveshapes responsive to each said combination waveshape data point whereby said musical tone having anharmonic overtones is produced.

15. In a musical instrument according to claim 14 wherein said plurality of waveshape reading means comprises;

a keyswitch state detect means wherein a detect signal is generated in response to each actuated keyswitch in said keyboard array of keyswitches, a frequency number means for generating a plurality of frequency numbers in response to each said detect signal, and a plurality of waveshape addressing circuitry means each of which is associated with a corresponding one of said plurality of waveshape reading means and where each of which is responsive to a corresponding one of said plurality of frequency numbers whereby said component waveshape data points are sequentially and repetitively read out of each one of a corresponding one of said plurality of component waveshape memory means.

16. In a musical instrument according to claim 14 wherein said plurality of waveshape memory means comprises a first component waveshape memory, a second component waveshape meory, and a third component waveshape memory.

17. In a musical instrument according to claim 16 wherein said first component waveshape memory stores a component waveshape data set corresponding to a periodic waveshape having non-zero harmonic coefficients for the harmonic number sequence 1,5,7,11 and 13, wherein said second component memory stores a component waveshape data set corresponding to a periodic waveshape having non-zero harmonic coefficients for the harmonic number sequence 2,4,8,10,12,14 and 16 and wherein said third harmonic component waveshape data set corresponding to a periodic waveshape having non-zero harmonic coefficients for the harmonic number sequence 3,6,9 and 15.

* * * * *